US005181473A

United States Patent [19]

Petit et al.

[11] Patent Number: 5,181,473

[45] Date of Patent: Jan. 26, 1993

[54] RAIL VEHICLE BOGEY WITH INDEPENDENT MOTORIZED WHEELS

[75] Inventors: Jean-Michel Petit, Le Pre St Gervais; Alain Devallez, Raismes, both of France

[73] Assignee: GEC Alsthom SA, Paris, France

[21] Appl. No.: 726,095

[22] Filed: Jul. 5, 1991

[30] Foreign Application Priority Data

Jul. 5, 1990 [FR] France ..... 90 08545

[51] Int. Cl.[5] ..... B61C 17/00

[52] U.S. Cl. ..... 105/133; 105/140; 105/218.2; 105/96.1

[58] Field of Search ..... 105/218.2, 224.05, 224.06, 105/224.1, 199.1, 453, 133, 140, 96, 96.1, 172, 138, 179, 180, 182.1

[56] References Cited

U.S. PATENT DOCUMENTS 1,880,953 10/1932 Fageol ..... 105/133
3,806,148 4/1974 Boulton ..... 105/218.2
4,241,666 12/1980 Marcusson et al. ..... 105/133
4,362,109 12/1982 Panagin ..... 105/218.2
4,658,734 4/1987 Mroz ..... 105/169

FOREIGN PATENT DOCUMENTS 2088801 6/1982 United Kingdom .

*Primary Examiner*—Mark T. Le
*Attorney, Agent, or Firm*—Sughrue, Mion, Zinn, Macpeak & Seas

[57] ABSTRACT

A rail vehicle bogey includes a transverse chassis (1) carrying the body of the vehicle. Indepently motorized wheels are connected to the chassis via resilient hinges (6) including a pivotable hinge arm which supports a traction motor (20) for independently motorizing each bogey wheel. Each arm supports the traction motor by a cradle defined by two branches of the hinge arm forming a fork and interconnected at one end by a spacer. One fork of each arm constitutes a transmission housing between the motor (20) and a wheel (4), whose axis is offset with respect to the axis of the corresponding independently motorized wheel (4).

13 Claims, 5 Drawing Sheets

RAIL VEHICLE BOGEY WITH INDEPENDENT MOTORIZED WHEELS

The invention relates to a bogey having independent motorized wheels and equally suitable for commuter rail vehicles and for high speed trains.

BACKGROUND OF THE INVENTION

Designing a bogey to have independent wheels provides numerous advantages, in particular in the following areas:

high travel speeds since the stability of such a bogey as characterized by its critical speed is very high; and commuter vehicles with a low deck or floor since there is no longer an axle shaft to interfere with the floor which is to be located as low as possible above the rails.

Such bogies with independent wheels have already been made for load-carrying bogies.

For making a motorized bogey with independent wheels, various motorizing concepts have already been proposed, in particular concepts having one motor driving each wheel. However these solutions are not satisfactorily since they concern:

either motorizing one set of the wheels only and consequently limiting the adhesion mass of the vehicle;

or else monitoring all four wheels of the bogey in which case the motor and gear box units are not suspended and are integral with the corresponding wheels.

SUMMARY OF THE INVENTION

To mitigate these drawbacks, it is proposed to provide a transmission in which each motor is fully suspended, in which the bogey is fully motorized, and in which the bogey suspension is levelled, taking up little height, as is required of a bogey for a passenger transport vehicle.

The bogey is mainly constituted by a load-supporting chassis that supports the body. The connections between the wheels and the chassis via articulated arms are obtained by resilient hinges in a disposition that is well known in the road vehicle and railway arts. However, these hinged arms (or lever arms) have the special feature of themselves being capable of constituting transmission housings and of supporting respective traction motors which are thus fully suspended.

The present invention thus provides a bogey having independent motorized wheels, the bogey comprising a transverse load-carrying chassis, the wheels being connected to the chassis by arms hinged to the chassis by means of resilient hinges, each arm supporting a traction motor, the bogey being characterized in that each motor is offset relative to the wheel which it drives, with each arm constituting a transmission housing between the motor that it supports and the corresponding wheel.

BRIEF DESCRIPTION OF THE DRAWINGS

The invention will be better understood and other advantages will appear on reading the following description given by way of non-limiting example and made with reference to the accompanying drawings, in which.

DESCRIPTION OF THE PREFERRED EMBODIMENTS

Figure 1:
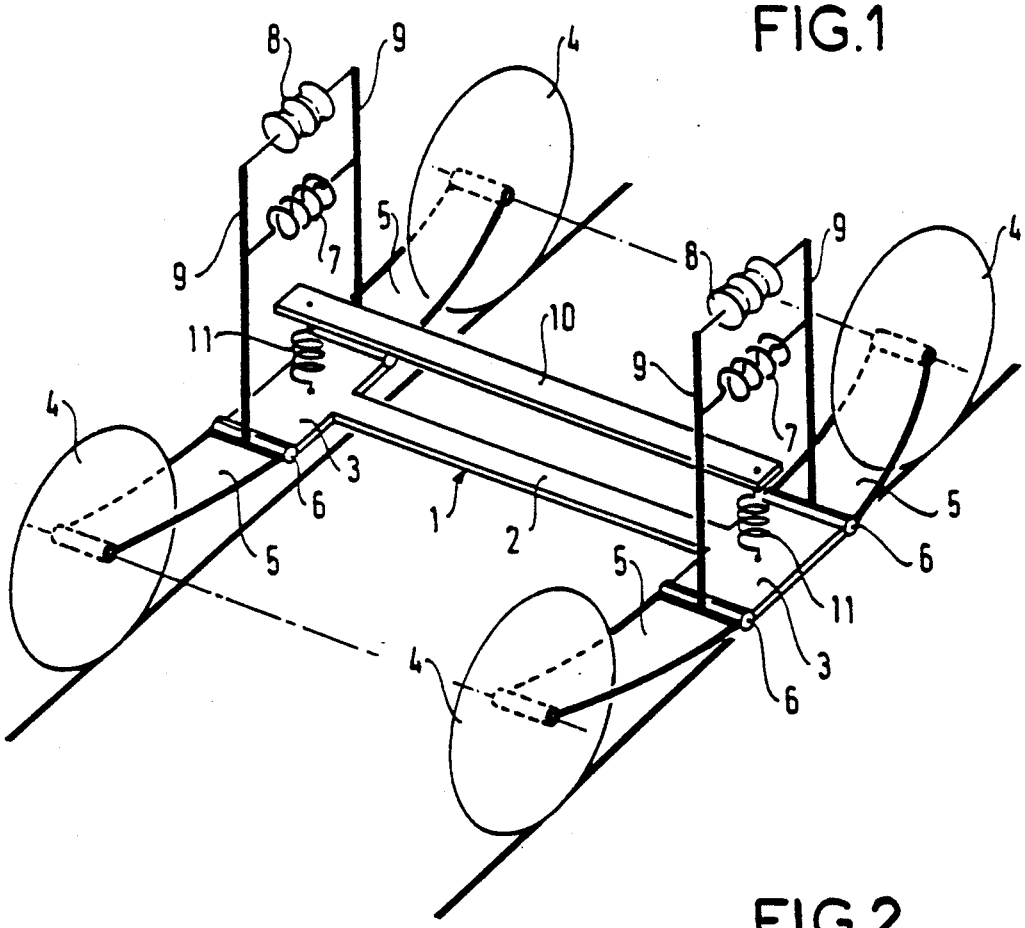
FIG. 1 is a diagram showing the theory of a bogey of the invention having independent motorized wheels.

FIG. 1 is a diagram of a bogey of the invention having four independent wheels. The bogey comprises a load-carrying transverse chassis 1 made up of a cross-member 2 which is terminated at each end by a horizontal longitudinal member 3 which is perpendicular to the cross-member and which gives the chassis the general shape of the capital letter "I". The wheels 4 are connected to the chassis 1 via hinge arms 5. A resilient hinge 6 connects each arm 5 to the corresponding end of one of the longitudinal members 3. The hinge arms 5 are designed to support the traction motors on the wheels. They also constitute transmission housings between the motors and the wheels. The motors are thus fully suspended.

The invention thus makes it possible to design a special suspension for a bogey. It is possible functionally to separate the suspension per se for supporting the tare weight of the vehicle, and the additional levelling suspension which is subjected to the variable load of the vehicle carrying passengers. These separate suspension functions are performed by members which, although different, may be situated close to one another. The tare weight of the vehicle is taken up by suspension members 7 which may be constituted by helical springs, by torsion bars, or by assemblies of metal and rubber. The additional levelling suspension is provided by a suspension member 8. The suspension members 7 and 8 may be situated horizontally and on either side of the bogey between vertical brackets 9 which are fixed to the hinge arms 5 close to their hinges 3. As shown in FIG. 1, these suspension members are disposed parallel to the rails.

A load-carrying cross-member 10 fixed to the body of the vehicle is supported by the chassis 1, for example via two laminated metal-and-rubber blocks 11. In conventional manner, these blocks 11 provide transverse suspension for the vehicle.

The body may be driven and rotated by conventional means such as longitudinal connecting rods and a steering pivot ring.

Figure 2:
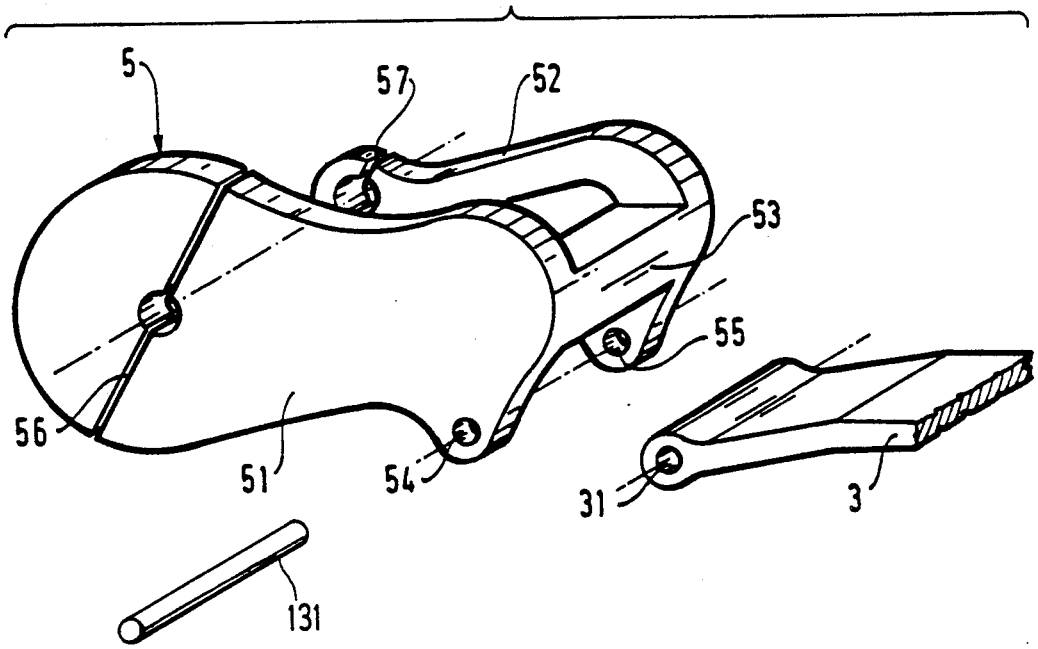
FIG. 2 shows a hinge arm of a bogey of the invention.

FIG. 2 is a perspective view of a hinge arm 5. The hinge arm 5, which may also be called a motor-and-gearbox arm since it serves as a transmission housing between the motor and the wheel, is constituted by two parts that are fixed together: a fork and a cradle.

The fork has a first branch 51 and a second branch 52 which are interconnected by an end spacer 53. The two branches 51 and 52 are of different sizes. The branch 51 is larger in volume than the branch 52 since it is designed to contain the transmission components between the motor and the wheel. The branches 51 and 52 include respective bearings 54 and 55 situated to one side of the spacer 53. The arm may be hinged to the chassis by means of a shaft 131 passing through the bearings 54 and 55 and also passing through a bearing 31 situated at the end of the side longitudinal member 3 of the chassis.

The hinge bearings may advantageously be made of metal-and-rubber parts suitable for withstanding the drive forces of the arm elastically when traction and breaking couples are applied, and suitable for withstanding transverse forces due to the wheel being guided by the track.

At its end opposite from the hinge, the fork rests via ball bearings on the two stub axles of the wheel which is engaged in the fork.

The free ends of the branches 51 and 52 may also be separated from the arm along join planes 56 and 57 including the axis of the wheel and thus enabling the wheel to be installed and removed.

The cradle is the portion that supports the traction motor. It is situated in the vicinity of the hinge and it serves to space the two branches apart. It may be constituted by a metal plate disposed between the two branches or by spacers, one of which may be constituted by the end spacer 53. The motor may be fixed in place by means of screws. The motor is fixed to the cradle in such a manner as to enable the motor shaft to drive a set of gears situated inside the branch 51 which then serves as a housing. The motor is advantageously disposed in such a manner that its shaft is horizontal and extends transversely relative to the wheel.

Figure 3:
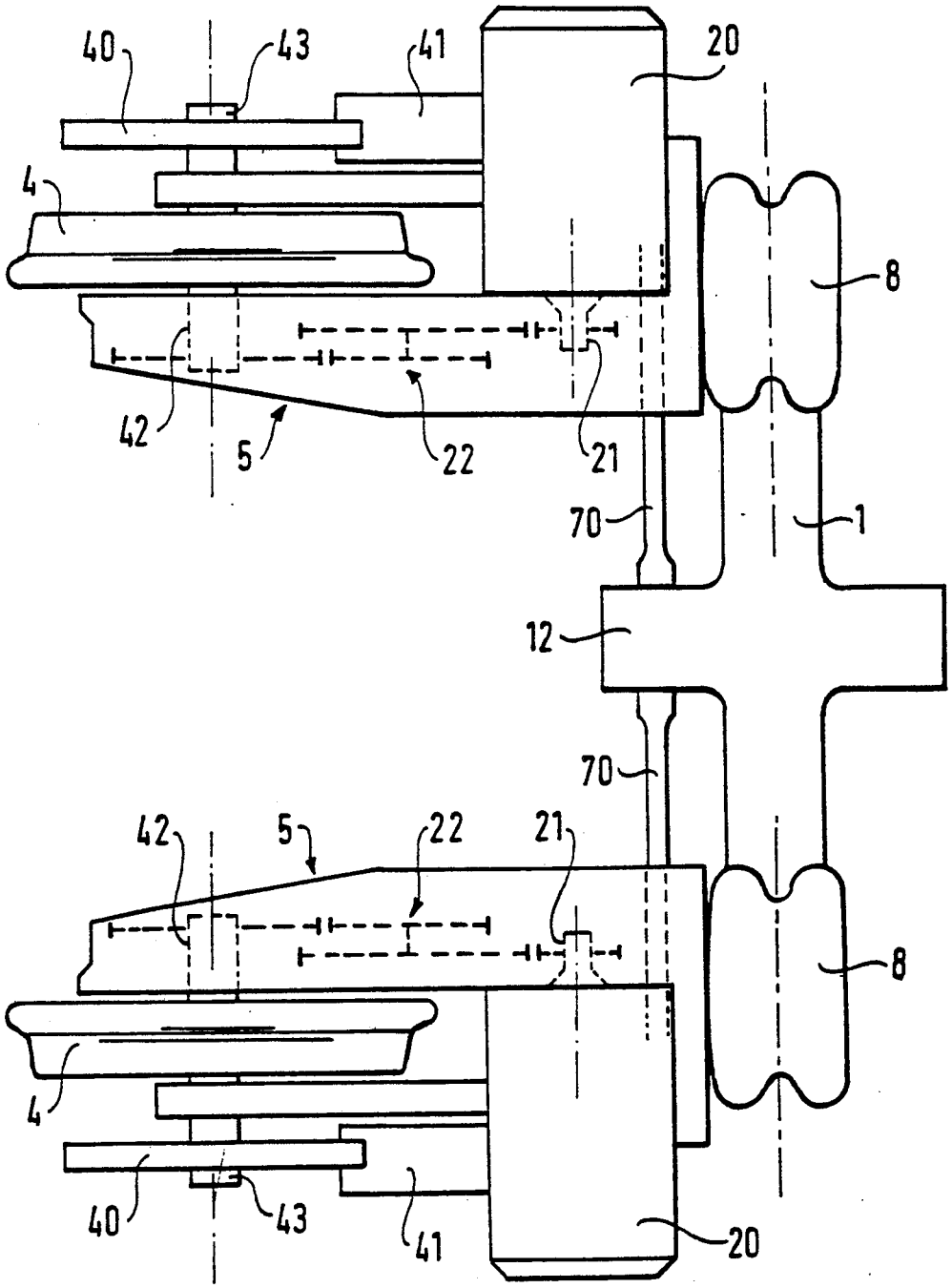
FIG. 3 is an exploded, perspective view of a portion of the bogey of the invention.

FIG. 3 shows a portion of a bogey comprising a set of wheels 4 received in the housings provided therefor by the hinge arms 5. The arms 5 are hinged to the load-carrying chassis 1 by resilient hinges (not shown). This figure shows the drive motors 20 in place on the arms 5, together with torsion bars 70, and additional levelling suspension members 8. The shaft 21 of the motor 20 rotates the stub axle 42 of the corresponding wheel 4 via a set of gears 22. Each torsion bar 70 is fixed at one end to a projection 12 from the central portion of the chassis and at its other end to one of the hinge arms 5. The torsion bars 70 serve as vehicle tare-weight suspension members and thus perform the same function as the members referenced 7 in FIG. 1. The additional suspension members 8 which are shown as being pneumatic items are placed between thrust points integral with the suspension arms. These members 8 could also be constituted by other variable flexibility resilient items such as blocks made of rubber and metal, or hydropneumatic or hydraulic actuators. The thrust surfaces for these members may be constituted by brackets as sketched in FIG. 1, or they may be constituted by the traction motors themselves.

This disposition in the form of functionally separate suspension systems contributes to reducing size in a vertical direction. In addition, it also makes it possible to obtain more favorable dimensioning for components such as the associated sources of fluid since the additional suspension supports only a fraction of the total load.

The braking system may comprise disks 40 fixed to the stub axles 43 of the wheels 4. Calipers 41 supporting the brake pad actuators may be fixed to the traction motors themselves. The braking system further includes an electromagnetic brake shoe pressing against the two lever arms situated between the wheels that run on the same rail.

Figure 4:
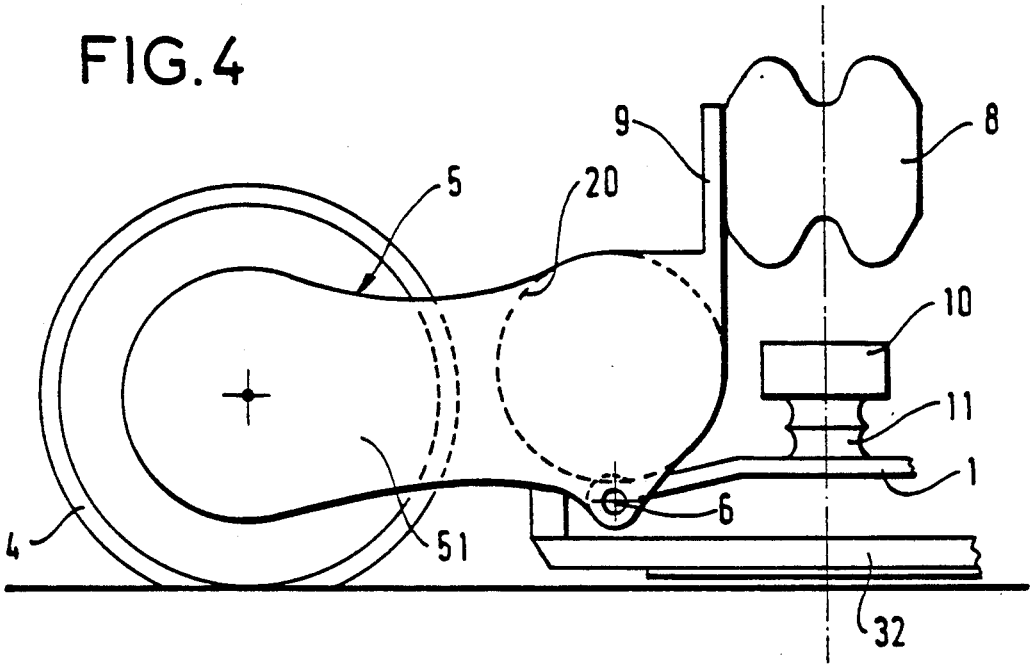
FIG. 4 is an outside view of a portion of the bogey of the invention.

FIG. 4 shows a wheel 4 of the bogey, its hinge arm 5 represented by its branch 51, and the resilient hinge 6 between the arm and the chassis 1. The motor 20 is hidden behind the branch 51 and it supports the bracket 9 on which one of the faces of the additional suspension member 8 is fixed. The chassis 1 supports the cross-member 10 via a resilient block 11. The hinge arms 5 are capable of supporting one electromagnetic shoe 32 per rail.

Figure 5:
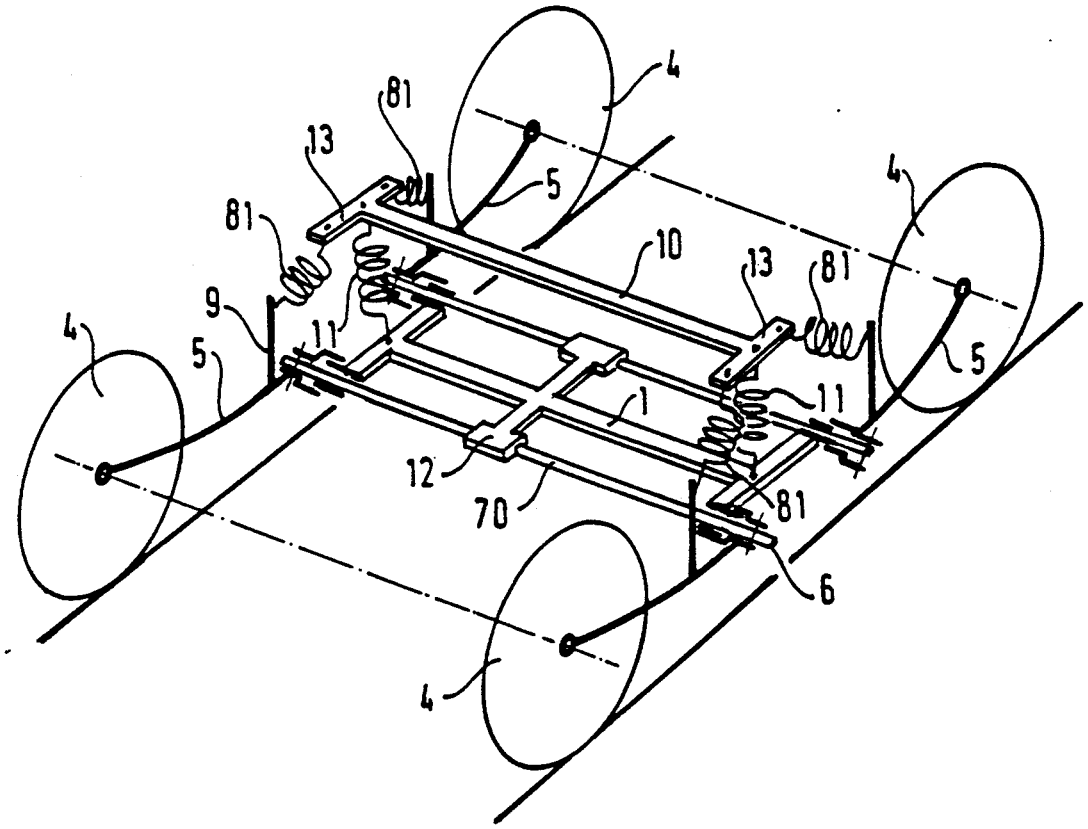
FIG. 5 is a diagrammatic view of a variant bogey of the invention.
Figure 6:
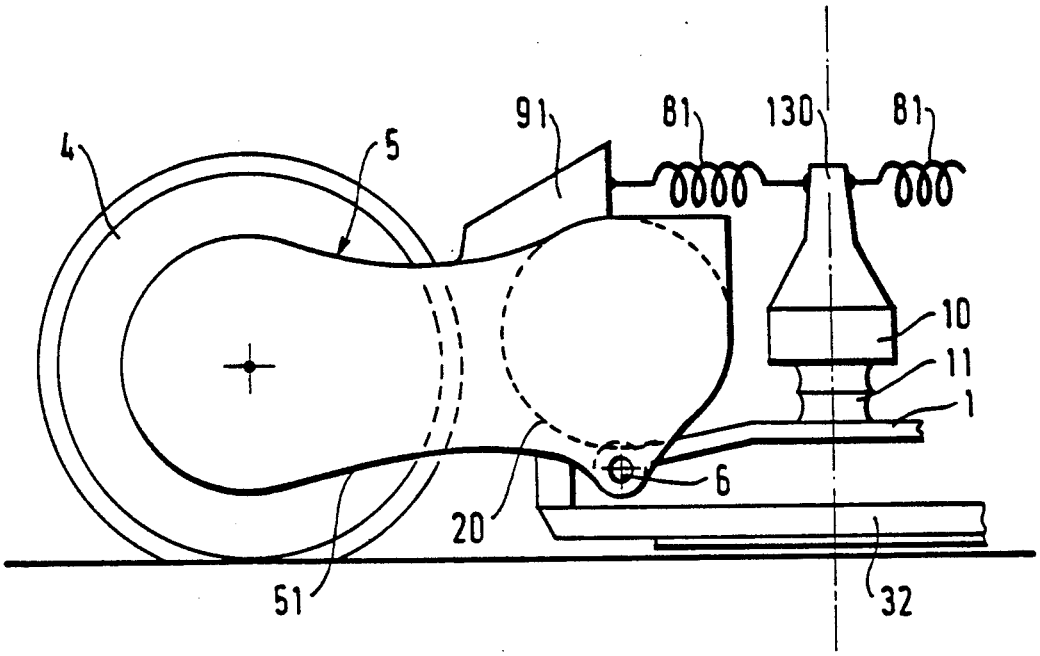
FIG. 6 is a detailed view of the variant embodiment shown in FIG. 5.

The bogey of the invention makes it possible to design a particularly advantageous disposition for providing vehicle suspension. This disposition is shown in FIG. 5 where the same references as used in the preceding figures refer to the same items. The load-carrying cross-member 10 is integrated in the additional levelling suspension to constitute the midpoints of the additional suspension springs 81, whatever kind of spring they may be. This disposition serves to balance the load-carrying cross-member itself disposed on the transverse suspension blocks 11, and to transmit the drive forces resiliently via the suspension itself. In FIG. 5, references 13 designate the items of the cross-member designed to serve as the midpoints for the additional suspension springs. In FIG. 6 which is a detail view of the bogey shown diagrammatically in FIG. 5, these items are designated by references 130. These items may be constituted by metal studs applied to the load-carrying cross-member. It may be observed that the bracket 91 on which a portion of the suspension member 81 is fixed, is otherwise disposed on the motor 20.

Figure 7:
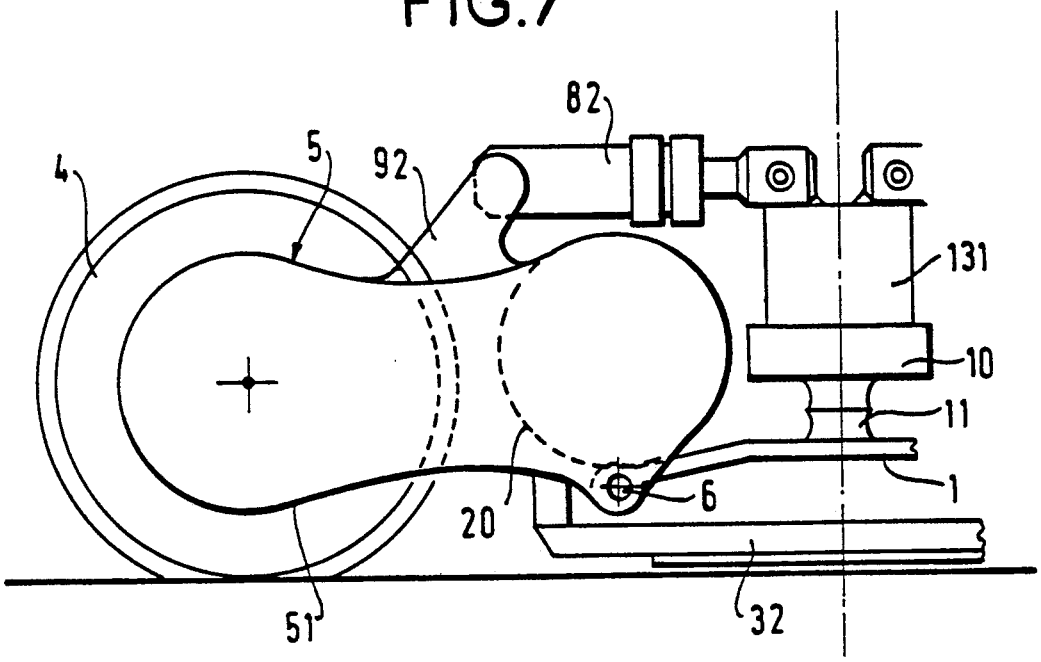
FIG. 7 is another detailed view of the variant embodiment shown in FIG. 5.

In FIG. 7, the additional suspension members are actuators 82 exerting their action between studs 131 applied to the load-carrying cross-member and the brackets 92 which are fixed to the motors.

Figure 8:
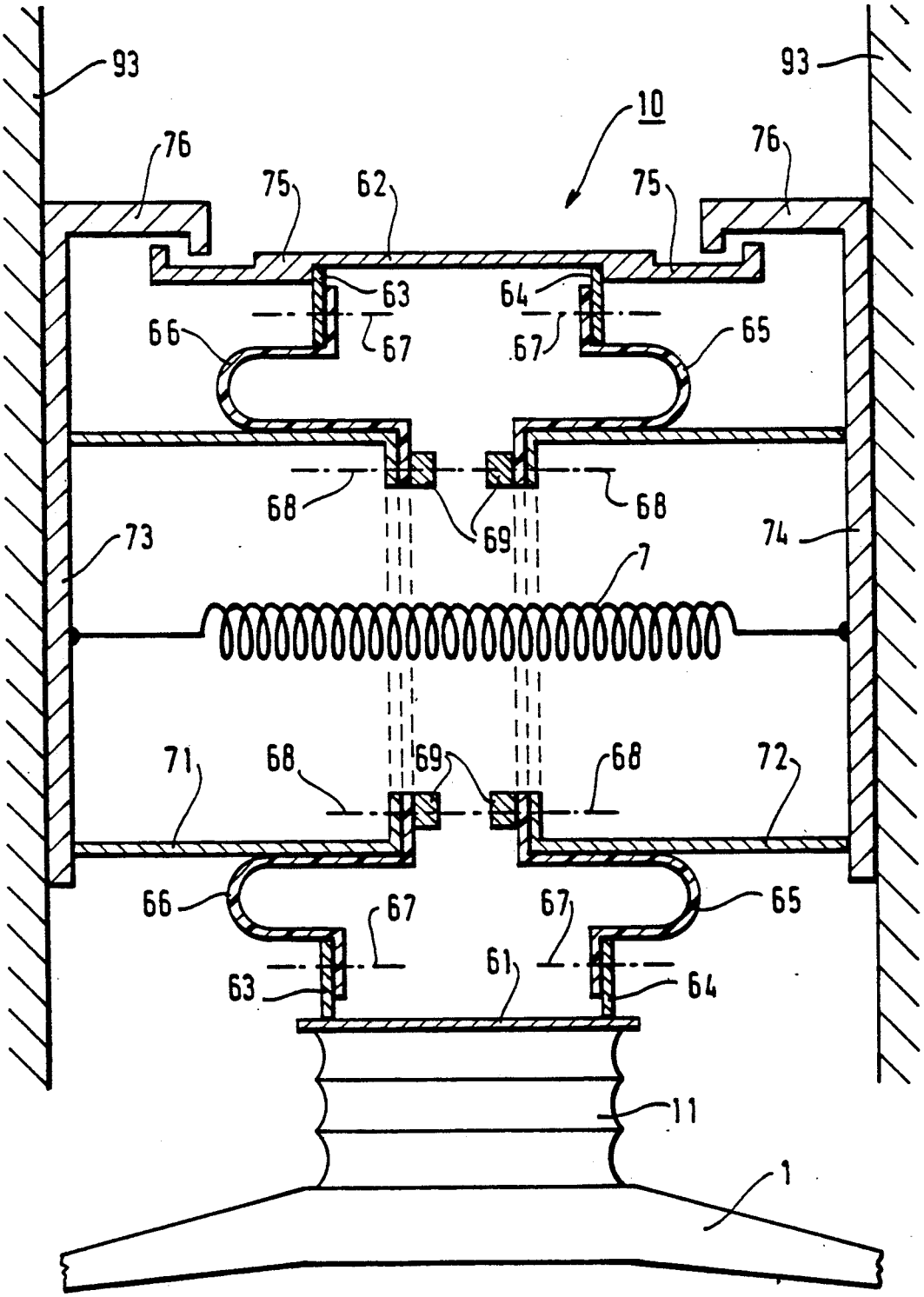
FIG. 8 shows a detail of a bogey of the invention which makes use of a special pneumatic suspension system.

In FIG. 8, the load-carrying cross-member 10 is shown in cross section, and is constituted by an airtight box having a bottom face 61 fixed to the transverse suspension blocks 11, a top face 62 supporting the body of the vehicle, two side faces 63 and 64 each having a central hole, and two membranes 65 and 66 pierced by respective central holes and constituting pneumatic cushions. The membranes 65 and 66 are fixed at their centers to two tubular supports 71 and 72 which are respectively fixed to the brackets 93 of the traction motors via their bottoms 73 and 74. The membranes 65 and 66 are hermetically connected to the top and bottom faces 61 and 62 respectively via fixing means 67 represented by dot-dashed lines. They are also hermetically connected to the tubular supports via fixing means 68 also represented by dot-dashed lines and which include internal abutments 69 imposing a minimum distance between the brackets 93. External abutments 75, e.g. fixed to the top face 62 and associated with counter abutments 76 fixed to the bottoms 73 and 74, serve to prevent the brackets 93 moving too far apart. These two types of abutment enable the bogey to be raised and provide an emergency abutment in the event of a shortage of suspension fluid. The inside volume of this structure makes it possible to integrate the tare weight supporting suspension spring 7, thereby reducing overall bulk. As for any other pneumatic suspension member, the body includes a device suitable for obtaining a variable inside pressure proportional to the spacing between the brackets.

We claim:

1. In a rail vehicle bogey comprising independently motorized wheels, a transverse chassis carrying a body of a vehicle, arms hinged to the chassis by means of hinges connecting the wheels to the chassis, each said arm supporting a traction motor, the improvement further comprising each said traction motor having an axis offset relative to the axis of the wheel which is driven by said traction motor, and each said arm constituting a transmission housing between the traction motor supported by said arm and a corresponding independently motorized wheel.

2. The bogey according to claim 1, wherein each said arm comprises a fork receiving a wheel, and a cradle supporting a respective traction motor, said cradle being defined by two branches of said fork interconnected by an end spacer.

3. The bogey according to claim 2, wherein one of said two branches of each said arm constitutes the transmission housing.

4. The bogey according to claim 2, wherein each said hinge comprises a shaft engaged with bearings of said two branches of each said arm and with a bearing of a longitudinal member of said chassis.

5. The bogey according to claim 1, wherein said arms support pairs of vertical brackets, and horizontal suspension means are fixed between each said pair of the vertical brackets situated on a side of the bogey.

6. The bogey according to claim 5, wherein said horizontal suspension means comprise a suspension member for tare weight of the vehicle and an additional leveling suspension member.

7. The bogey according to claim 1, wherein a torsion bar is fixed between each said arm and the chassis for serving as a vehicle tare weight suspension member, and an additional leveling suspension means is fixed between vertical brackets supported by a pair of said arms located on one side of the bogey.

8. The bogey according to claim 5, wherein said vertical brackets are fixed to said arms, at locations adjacent to said traction motors.

9. The bogey according to claim 5, wherein a load-bearing cross-member for supporting the vehicle body is mounted on the chassis via resilient means.

10. The bogey according to claim 9, wherein the load-bearing cross-member constitutes a middle element of the horizontal suspension means.

11. The bogey according to claim 1, wherein a load-bearing cross-member for supporting the vehicle body is mounted on the chassis via resilient means, said load-bearing cross-member being a hermetically sealed box constituting a pneumatic vertical and horizontal suspension means, said box being located between vertical brackets situated at each side of the bogey.

12. The bogey according to claim 11, wherein said box includes internal abutments for imposing a minimum distance between the vertical brackets situated at each side of the bogey.

13. The bogey according to claim 11, wherein said box includes external abutments for imposing a maximum distance between the vertical brackets situated at each side of the bogey.

* * * * *